United States Patent [19]

Blicher

[11] 4,432,831

[45] Feb. 21, 1984

[54] BELT MAKING METHOD AND APPARATUS

[76] Inventor: Harold Blicher, 5765 Cote St. Luc Rd.; Apt. 214, Hampstead, Quebec, Canada

[21] Appl. No.: 421,478

[22] Filed: Sep. 22, 1982

[51] Int. Cl.[3] ..... B32B 31/00

[52] U.S. Cl. ..... 156/467; 156/202; 428/126

[58] Field of Search ..... 156/200–202, 156/461–465, 467; 428/126

[56] References Cited

U.S. PATENT DOCUMENTS 3,718,364 9/1973 Edelman ..... 156/467 X 3,880,697 4/1975 Off et al. ..... 156/202 X

*Primary Examiner*—David A. Simmons

*Attorney, Agent, or Firm*—David S. Fishman

[57] ABSTRACT

The invention relates to a method and apparatus for forming fused seamless belts from an outer covering and an interlining material along with an adhesive. In accordance with the method, the outer covering fabric is folded over the interlining material to enclose the interlining material. The outer covering material is folded in a double layer on either side of the belt on the bottom surface of the interlining material. The belts are formed by applying heat under pressure to the folded arrangement whereby to fuse the various layers together.

3 Claims, 8 Drawing Figures

BELT MAKING METHOD AND APPARATUS

BACKGROUND OF INVENTION (a) Field of the Invention

The invention relates to a method and apparatus for forming fused seamless belts. The invention also relates to a fused seamless belt formed by the method and apparatus.

(b) Description of Prior Art

Belts for clothes such as dresses, coats, etc. are presently formed with sewing machines so that seams extend along the length of the belts. This method of forming belts is expensive in that it cannot be automated and sewing machine operators are required for the forming of each belt.

In addition, the belts so formed will normally include a cardboard-like interlining so that the belts are not readily washable or even dry cleanable. Thus, after the article of clothing has been worn for some time and cleaned several times, the color of the article of clothing will be quite different from the color of the belt.

SUMMARY OF INVENTION

It is therefore an object of the invention to provide an apparatus and a method for forming a seamless belt.

It is a further object of the invention to provide a seamless belt formed by the method and apparatus.

It is a still further object of the invention to provide such a belt which is both washable and dry cleanable.

In accordance with the invention, there is provided an apparatus for forming fused seamless belts from an outer covering fabric, an interlining material, and an adhesive for fusing the interlining material to the outer covering fabric. The apparatus includes an input end for bringing together the interlining material and the outer covering fabric and a folding section for folding the outer covering fabric around the interlining material to provide a folded arrangement. A heating and fusing section is provided for heating the adhesive in the folded arrangement and thereby fusing the outer covering fabric to the interlining material by the application of pressure on the folded arrangement to provide a fused seamless arrangement. An output end is provided for drawing off the fused seamless arrangement. In the apparatus, the folding section comprises means for providing a double fold of the outer covering fabric on each side of the folded arrangement and underlying the interlining material.

From a different aspect, and in accordance with the invention, there is provided a method for forming a fused seamless belt from an outer covering fabric and an interlining material along with an adhesive. The method includes the step of bringing together the outer covering fabric with the interlining material and the adhesive material, and folding the outer covering fabric around the interlining material so that the outer covering fabric encloses the interlining material, the layer of the outer covering fabric underlying the interlining material comprising a double fold on each side thereof. The method also includes the step of heating the folded arrangement under pressure whereby the adhesive will cause the layers to fuse with each other.

From a still further aspect, and in accordance with the invention, there is provided a fused seamless belt comprising an interlining with an outer covering fabric enclosing the interlining. The outer covering fabric comprises double folds on each side of the interlining at the bottom surface thereof. The outer covering fabric is fused to the interlining by an adhesive material applied under heat and pressure.

BRIEF DESCRIPTION OF DRAWINGS

The invention will be better understood by an examination of the following description together with the accompanying drawings in which.

DESCRIPTION OF PREFERRED EMBODIMENTS

Figures 1, 2:
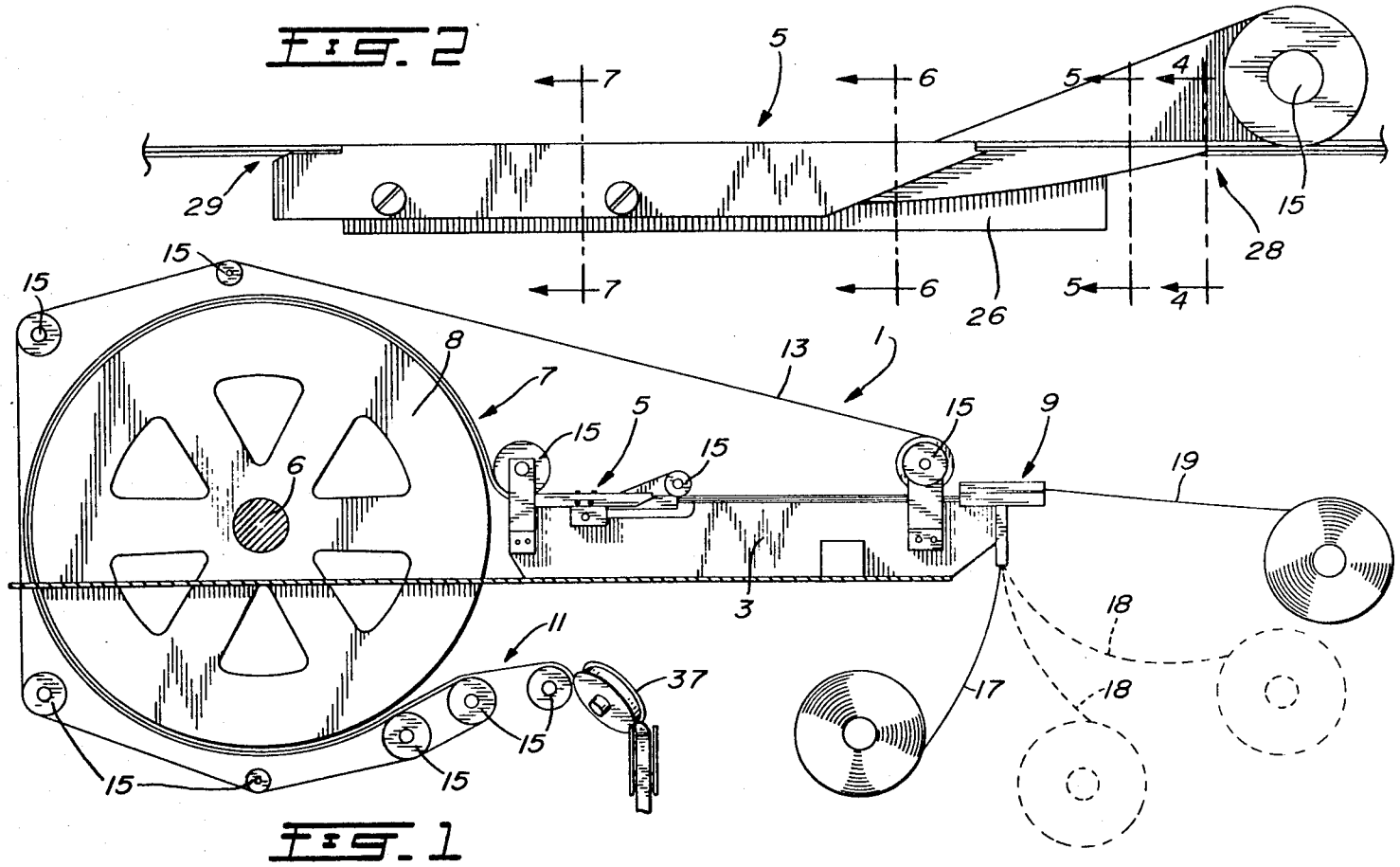
FIG. 1 is a somewhat schematic view of the apparatus for forming the seamless belts.
FIG. 2 is a more detailed view of the folding section of the apparatus illustrated in FIG. 1.
Figure 3:
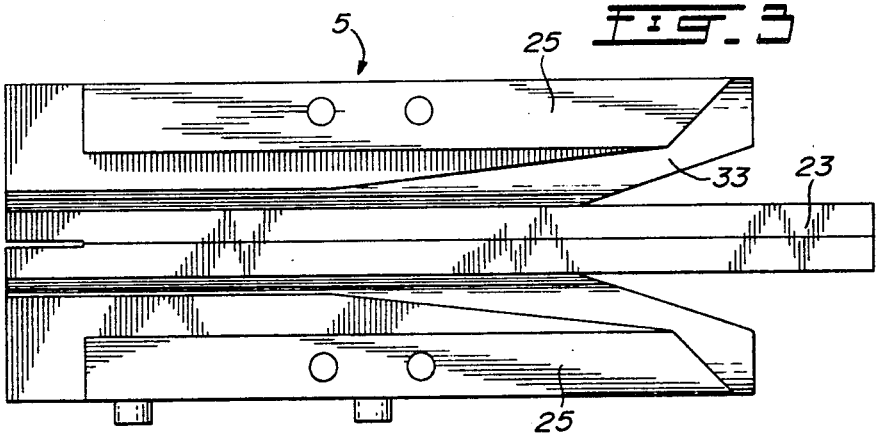
FIG. 3 is a top view of FIG. 2.
Figure 4:
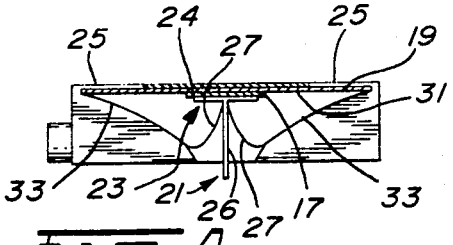
FIGS. 4 to 7 are cross-sections through 4—4 to 7—7 respectively in FIG. 2.
Figure 5:
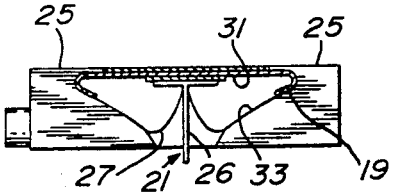

Referring to FIG. 1, the apparatus in accordance with the invention, illustrated generally at 1, includes a work table 3 having a folding section 5. The apparatus also includes a heating and fusing section 7 comprising a wheel 8 rotatable about axle 6. The apparatus moves material from the feed end 9 to the output end 11 on an endless belt 13 whose path is defined by a series of idler rollers 15. Fed in at the input end is an interlining material 17 and an outer covering fabric 19. The interlining is preferably made of a material which is washable and/or dry cleanable. As the folded belt will be adhesively secured in its folded condition, and the fabric will be adhesively secured to the interlining, it will be necessary to provide adhesive at the input end. This can be done by either pre-impregnating the interlining material with such an adhesive, or by providing rolls of adhesive material such as shown in dotted lines at 18. As will be appreciated, the particular setup used will be a function of just how the adhesive material is to be provided.

The heart of the machine resides in the folding section 5, and attention is directed to FIGS. 2 to 7 for a better description of the folding section. As seen in FIGS. 4 to 7, the folding section includes a center post 21 which includes a T-shaped element having a platform 24, which carries the fabric and interlining material and which extends longitudinally of the folding section, and a separator post 26. The folding section also has top walls 25, and the center post 21 further includes vertically descending central flared side walls 27. As can be seen in FIGS. 4 to 7, the flare of the side walls 27 increases from the input end 28 to the output end 29 of the folding section so that, at the output end of the folding section, the flare is completely horizontal.

Figure 7:
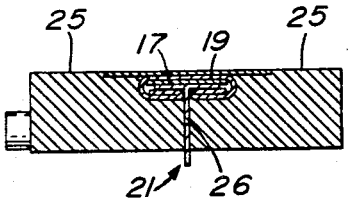

Between the input end 28 and the output end 29, vertically descending, inwardly directed, lobes 30 are formed. The angle between the lobes 30 and top walls 25 decreases, as does the thickness of the lobes, in the direction of the output end and the lobes completely disappear at the output end as is seen in FIG. 7.

Figure 6:
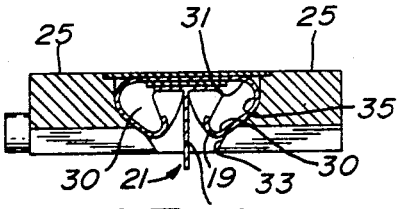

The folding section also has a top inner surface 31 which meets with a vertically ascending side wall 33. As can be seen, at the input end, the top inner surface 31 is at its widest and the junction between 31 and 33 constitutes a sharp angle. The width of the inner surface 31 decreases from the input end 28 to the output end 29, and the junction between 31 and 33 becomes rounded in the same direction so that, as seen in FIG. 6, 29 and 31 are joined by an arc 35. In the final stage, as shown in FIG. 7, 31 and 27 merge, and the merged 31 and 27 are parallel to 33 and the two lengths are joined together by a very short arc.

In operation, the apparatus works as follows:

The interlining material 17 and the outer covering fabric 19 are brought together at the input end 9 of the apparatus and carried along the work table 3 by the endless belt 13. As seen in FIGS. 4 to 7, the width of the outer covering fabric 19 is greater than the width of the interlining material 17. The interlining is disposed centrally of the fabric and the interlining and fabric are in registration along the lengths thereof. They are then brought into the folding section, and the folding section operates on the material as follows:

As can be seen, the platform 24 is substantially the same width as the width of the interlining 17. Thus, the interlining will not be folded in the operation.

Figure 8:
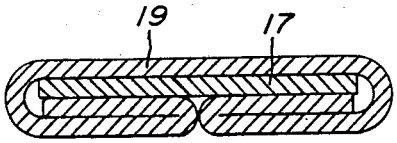
FIG. 8 is an end view of the belt formed in accordance with the invention herein.

The outer ends of the fabric covering 19 are first bent downwardly and inwardly by the decreasing sharp angle junction between 31 and 33. As the width of 31 decreases, the top surface of 19 will similarly decrease and the outer ends thereof will continue to be folded downwardly and inwardly. When the material is engaged by the lobes, the outer ends thereof will begin to be forced in an outward direction, i.e., towards the outer sides of the section 5. Finally, the fabric will be folded to include a double flap on each half with the double flap underlying the interlining as shown in FIG. 8, and with the fabric covering material completely enclosing the interlining.

The folded fabric covering and interlining is then led on to the heating and fusing section. In this regard, the wheel 8 will include a heating element, and the outer surface of the wheel 8 will have a smooth flat finish. The endless belt 13 is arranged to be tight against the outer surface of the wheel 8 so that, when the folded material is led to the wheel, the heat of the wheel will melt the adhesive, and the pressure of the endless belt against the folded arrangement together with the melted adhesive will cause the several layers to be fused to each other. The wheels 8 will, of course, move with and at the same speed as the endless belt.

The folded and fused material will then be drawn off onto, for example, a roll 37. The material can then be cut into the proper length for use as belts. Each length will then have a buckle mounted at one end and holes penetrated into the other end as well known in the art. In addition, the end opposite the buckle can also be made pointed or rounded depending on the design.

Although a particular embodiment has been described, this was for the purpose of illustrating, but not limiting, the invention. Various modifications, which will come readily to the mind of one skilled in the art, are within the scope of the invention as defined in the appended claims.

I claim:

1. Apparatus for forming fused seamless belts from an outer covering fabric, an interlining material, and an adhesive for fusing the interlining material to the outer covering fabric, said apparatus comprising:

an input end for bringing together said interlining and said outer covering fabric;

a folding section for folding said outer covering fabric around said interlining material to provide a folded arrangement;

a heating and fusing section for heating said adhesive in said folded arrangement and thereby fusing said outer covering fabric to said interlining material by the application of pressure on the folded arrangement to provide a fused seamless arrangement;

and an output end for drawing off the fused seamless arrangement;

said folding section having an input end and an output end;

said folding section having a center post including a T-shaped element extending longitudinally of said folding section and having a platform for carrying said outer covering fabric and said interlining material and a separation post;

said center post further including, at said input end, vertically descending flared side walls, the flare of said side walls increasing in the direction of the output end until they are completely horizontal at said output end;

said folding section further including an inner top surface and vertically ascending side walls, said top surface meeting said vertically ascending side walls at a sharp angled junction at said input end, said junction rounding in the direction of said output end and comprising a small arc at said output end, said vertically descending side walls and said vertically ascending side walls merging at said output end and being in parallel arrangement with said inner top surface at said output end; and said folding section still further comprising, between said input end and said output end, a pair of downwardly descending, inwardly directed, lobes, a lobe angle being defined between each lobe and said top inner surface, said lobe angles decreasing in the direction of said output end, the thickness of said lobe decreasing in the direction of said output end, whereby said lobes disappear at said output end;

whereby said folding section comprises means for providing a double fold of said outer covering fabric on each side of said folded arrangement and underlying said interlining material.

2. Apparatus as defined in claim 1 wherein said heating and fusing section comprises a wheel rotatable about an axle perpendicular to the longitudinal axis of said apparatus;

said wheel comprising a heating element;

said folded arrangement being led along the outer periphery of said wheel.

3. Apparatus as defined in claim 2 and further comprising means for moving said outer covering fabric and said interlining material along said apparatus, said means comprising an endless belt;

said endless belt moving said folded arrangement along said outer periphery of said wheel and applying pressure while said folded arrangement engages said outer periphery of said wheel;

whereby to aid in the fusing process.

* * * * *